US006158868A

United States Patent [19]

Chien

[11] Patent Number: 6,158,868

[45] **Date of Patent: *Dec. 12, 2000**

[54] NIGHT LIGHT WITH ANALOG TIME PIECE

[76] Inventor: Tseng-Lu Chien, 8F, No. 29, Alley 73, Lin-Shen Road, Shi-Chi Town, Taipei Hseng, Taiwan

[ * ] Notice: This patent is subject to a terminal disclaimer.

[21] Appl. No.: 09/049,131

[22] Filed: Mar. 27, 1998

[51] Int. Cl.[7] ..... F21V 33/00

[52] U.S. Cl. ..... 362/84; 362/253; 362/34; 368/10; 368/84; 368/67; 368/82; 368/62; 368/46; 439/13

[58] Field of Search ..... 362/84, 34, 253, 362/202; 368/10, 84, 67, 82, 33, 62, 46; 439/13

[56] References Cited

U.S. PATENT DOCUMENTS

| | | | |
|---|---|---|---|
| 2,972,125 | 2/1961 | Temple et al. . | |
| 3,329,851 | 7/1967 | Braeutigam et al. . | |
| 3,430,088 | 2/1969 | Beswick . | |
| 3,514,940 | 6/1970 | Keane, Jr. et al. | 58/50 |
| 3,744,236 | 7/1973 | Kishida | 58/50 |
| 4,253,170 | 2/1981 | Arthur L. Meisner | 368/67 |
| 5,339,296 | 8/1994 | Davis | 368/67 |
| 5,352,122 | 10/1994 | Speyer et al. | 439/13 |
| 5,469,342 | 11/1995 | Chien . | |
| 5,572,817 | 11/1996 | Chien . | |
| 5,577,335 | 11/1996 | Tucker | 40/311 |
| 5,599,088 | 2/1997 | Chien . | |
| 5,601,358 | 2/1997 | Chien . | |
| 5,611,621 | 3/1997 | Chien . | |
| 5,622,424 | 4/1997 | Brady | 362/226 |
| 5,638,339 | 6/1997 | Delortto | 368/10 |
| 5,662,408 | 9/1997 | Marischen . | |
| 5,667,394 | 9/1997 | Chien . | |
| 5,667,736 | 9/1997 | Chien . | |
| 5,683,164 | 11/1997 | Chien . | |
| 5,688,038 | 11/1997 | Chien . | |
| 5,704,705 | 1/1998 | Chien . | |
| 5,720,651 | 2/1998 | Chien . | |
| 5,722,757 | 3/1998 | Chien . | |
| 5,722,760 | 3/1998 | Chien . | |
| 5,746,501 | 5/1998 | Chien . | |
| 5,752,337 | 5/1998 | Chien . | |
| 5,754,064 | 5/1998 | Chien . | |
| 5,926,440 | 7/1999 | Chien | 368/10 |

*Primary Examiner*—Stephen Husar
*Assistant Examiner*—Ali Alavi
*Attorney, Agent, or Firm*—Howard C. Miskin; Gloria Tsui-Yip

[57] ABSTRACT

An electro-luminescent night light includes an analog time piece. The time piece display includes a mechanical analog clock illuminated by at least one electro-luminescent element positioned around the shaft assembly for the clock, the shaft extending from a conventional analog time piece unit powered by a conventional power source, with the electro-luminescent element being powered by prongs arranged to be inserted into an AC outlet or other power source, or to be powered by a separate battery and circuit that causes the electro-luminescent element to illuminate in case of a power failure or a condition such as the presence of smoke, an earthquake, or the like, the time piece also optionally including additional functions. In addition, the orientation of the time piece display may be made variable in order to enable the night light/time piece to be used in different orientations.

26 Claims, 7 Drawing Sheets

NIGHT LIGHT WITH ANALOG TIME PIECE

BACKGROUND OF THE INVENTION

1. Field of the Invention

This invention relates to a night light having a built-in time piece, and in particular to the addition of an analog time piece to the electro-luminescent night light.

2. Discussion of Related Art

The addition of a time piece to an electro-luminescent night light is disclosed in copending U.S. patent application Ser. No. 08/923,988, filed Sep. 5, 1997, herein incorporated by reference. This application discloses both analog and digital time pieces included in a night light unit. The present application is directed to a night light and time piece arrangement of the type generally disclosed in the copending application, but with an improved display.

The use of analog displays in the context of the present invention has a number of advantages over conventional backlit liquid crystal displays (LCDs) that might be combined with a night light. In particular, analog displays do not suffer from the limited viewing angle of a liquid crystal display, which makes the display difficult to read, and can be arranged to avoid the less than optimal light transmission properties of the liquid used in the LCD which, which when placed in front of a light source only transmits 47% of the emitted light, resulting in a greater than 50% reduction in brightness. In addition, an analog display of the type disclosed herein can be made as large as desired without significantly increasing the cost, avoiding the tooling and materials costs of the LCD unit, and also has the advantage that the analog display is not subject to operating temperature limitations to which an LCD display is subject.

Another disadvantage of conventional time piece displays, at least in the context of the present invention, is that they can only easily be read in a particular orientation. Not all sockets into which a night light might be plugged are vertically oriented, and any night light/time piece combination which did not account for the different possible orientations would be severely limited in use. In the case of an analog display, unless the number 12 is at the top of the display, it is very easy to read the wrong time.

Examples of prior arrangements for electro-luminescent elements are found in U.S. Pat. Nos. 4,097,918, 4,617,613, 4,774,641, 4,847,736, 5,662,408, 5,607,776, and 5,683,166, while prior time piece arrangements are found in U.S. Pat. Nos. 4,330,877, 4,775,964, 5,265,071, 5,513,153, 5,604,716, and 5,644,553. However, none of these patents discloses use of the elements in connection with an analog time piece and night light combination as claimed, and particularly one with environmental sealing provisions for preventing the electro-luminescent elements from being damaged by pollutants, dust, humidity, and water.

SUMMARY OF THE INVENTION

It is accordingly an objective the invention to provide a night light/time piece construction which provides increase viewing angle and brightness with low materials and assembly costs and without the environmental limitations of other types of time piece construction.

It is a further objective of the invention to provide a night light/time piece construction in which the night light is arranged to be plugged into a socket, and in which the orientation of the time piece may be varied to permit the time piece display to be read regardless of the orientation of the socket.

This objective is achieved by providing an electro-luminescent night light having an analog display, in which the display includes a mechanical clock illuminated by at least one electro-luminescent element positioned around a shaft assembly of the clock, the shaft extending from a conventional analog time piece unit powered by a conventional power source, with the electro-luminescent element being power by prongs arranged to be inserted into an AC outlet or other external power source, or to be powered by a separate battery and circuit that causes the electro-luminescent element to illuminate in case of a power failure or a condition such as the presence of smoke, an earthquake, or the like.

Furthermore, the objective of enabling the night light/time piece display orientation to be varied is achieved, according to various preferred embodiments of the invention, by including a mechanism for allowing the night light and/or the time piece to be rotated relative to a socket in which the night light/time piece is plugged, or is to be plugged. The rotation or swivel mechanism can take a variety of forms, including a swivel mechanism for the prongs of the night light, an adapter kit for enabling the night light/time piece assembly to be swivelled, detents on the time piece or on a protective cover on which the clock display numbers are printed or otherwise affixed for allowing the orientation of the protective cover to be changed, or a dial mechanism for rotating the clock face on which the clock display numbers or other time indicators are printed or otherwise affixed.

The power source for the time piece can be in the form of an AA, AAA, N, 9V, button-type, lithium, or other dry cell battery, with power to the electro-luminescent element being supplied on the other hand by prongs to be inserted into an AC wall socket or other desired power source, using a construction similar to those disclosed in U.S. Pat. No. 5,662,408, the above-cited copending U.S. patent application Ser. No. 08/923,988, and also in copending U.S. patent application Ser. No. 08/910,212, filed Aug. 13, 1998, and also incorporated herein by reference.

Those skilled in the art will appreciate that the electro-luminescent elements can take a variety of forms, including electro-luminescent panels or fibers, so long as the lighting elements are properly arranged relative to the shaft assembly for the clock hands to be visible at any time. The night light and time piece of the preferred embodiment of the invention may optionally be enclosed within the electro-luminescent element or elements in a protective case to protect the element(s) from environmental hazards such as ultraviolet light or humidity, or alternatively the preferred night light and time piece can use electro-luminescent elements which are already sealed within protective layers so that no further protection is needed.

In particular, according to one implementation of the preferred embodiment of the invention, using inexpensive non-environmental grade electro-luminescent elements, the housing of the night light and time piece combination includes front and back protective members sealed together, for example using an adhesive, gasket or o-ring, screws, ultra-sonic sealing, or other suitable means, to protect against moisture and dust, with the electro-luminescent element including an extension that passes through the seal and includes electrodes to contacted either directly by the prongs, or via a conductive member.

In another implementation of the preferred embodiment of the invention, an environmental grade electro-luminescent element enclosed within optional protective layers is used, in which case further protective housing members are not required, and the prongs or conductive members of the AC power supply can be arranged to electrically contact electrodes on the electro-luminescent element.

In addition, the night light and time piece of the preferred embodiment can easily be adapted to include additional control circuitry, such as a power fail circuit to switch to a battery power source in case of a power failure, and can also be combined with other functions such as an alarm, timer, emergency dial tone signal generator, fire, smoke, or carbon monoxide alarm, emergency flashing light, and other features.

Further details of the preferred embodiments of the invention are included in the following description, with reference to the drawings.

DETAILED DESCRIPTION OF THE PREFERRED EMBODIMENTS

Figure 1:
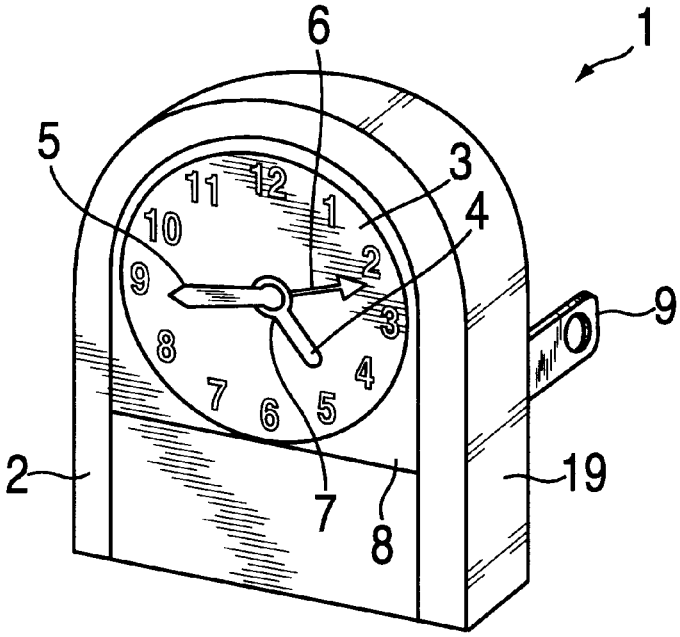
FIG. 1 is a perspective view of a night light and time piece constructed in accordance with the principles of a preferred embodiment of the invention.

FIG. 1 illustrates a night light and time piece 1 constructed in accordance with the principles of a preferred embodiment of the invention. As shown in FIG. 1, night light and time piece 1 includes a front housing member 2, having an opening 3 through which is visible an electro-luminescent lighting element and an analog time indicating mechanism. The analog time indicating mechanism includes an hour hand 4, a minute hand 5, and an optional second hand 6 rotatable around a shaft assembly 7 extending through the protective cover from a time piece unit 8. Extending from a back housing member 19 of the night light and time piece 1 are prongs 9. Prongs 9 may be arranged to connect with an electrical outlet.

Figure 2A:
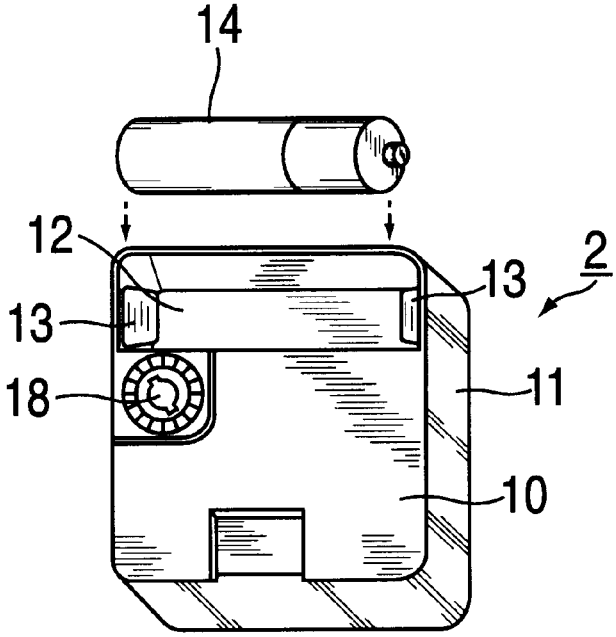
FIG. 2A is a perspective view of a time piece unit suitable for use in the night light and time piece construction illustrated in FIG. 1.
Figure 2B:
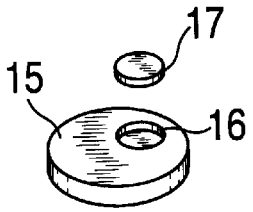
FIG. 2B is a perspective view of a variation of the time piece unit shown in FIG. 2A.

The time piece unit 2 includes a conventional analog timer gear mechanism (not shown) housed in one section 10 of the housing 11 of the timer, housing 11 also including a battery compartment 12 with terminals 13 for accommodating a conventional cylindrical type dry cell battery 14, as shown in FIG. 2A, or an alternative housing 15 with a disc shaped compartment 16 for accommodating a disc type battery 17. The back of the housing 10 includes a latch 18 to permit removal of a back cover so as to permit access to the timer mechanism so that the time can be set. The alternative timer also can use multiple latches 18 or knobs for function selection and adjustment.

Figure 3:
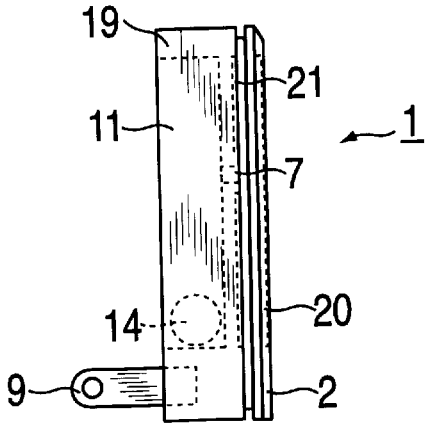
FIG. 3 is a side view of the preferred night light and time piece.
Figure 4:
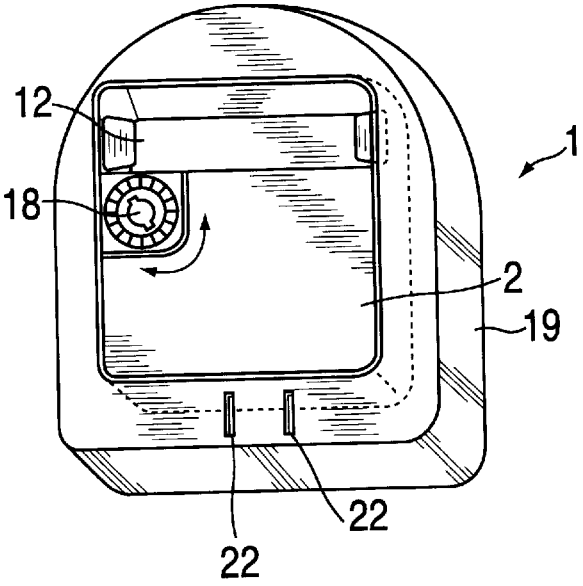
FIG. 4 is a perspective view of a rear side of the preferred night light and time piece.

As shown in FIG. 3, in addition to front housing member 2, the night light and time piece of the preferred embodiment of the invention includes a back housing member 19 which is secured to the front housing member 2 by any suitable attachment means, and which accommodates the time piece unit 2, which in this example includes time piece housing 11 and dry cell battery 14, although alternative housing 15 may be substituted. Also shown in FIG. 3 is the shaft assembly 7, an optional protective member 20, and an electro-luminescent element 21, described in more detail below. Power to the electro-luminescent element may be supplied not only through the prongs but, optionally, through components such as an inverter or another power source such as at least one additional battery for providing power in the event of a power failure, a smoke detector, a flood detector, an earthquake detector, and an animal detector FIG. 4 shows the rear of the night light and time piece 1 of the preferred embodiment of the invention, including openings 22 in back housing member 19 for accommodating prongs 9, and time piece unit 2 as described above.

It will be appreciated by those skilled in the art that the time piece unit 2 is conventional, and that any analog time piece which includes an outwardly extending shaft assembly to which time-indicating hands can be secured may be used in the night light and time piece construction of the preferred embodiment of the invention. Such analog time piece units are commercially available as separate units and are conventionally used, for example, in decorative wall and mantel clocks. Use of such inexpensive conventional time piece units is made possible by separating the illumination power supply from the time piece power supply.

Figure 5B:
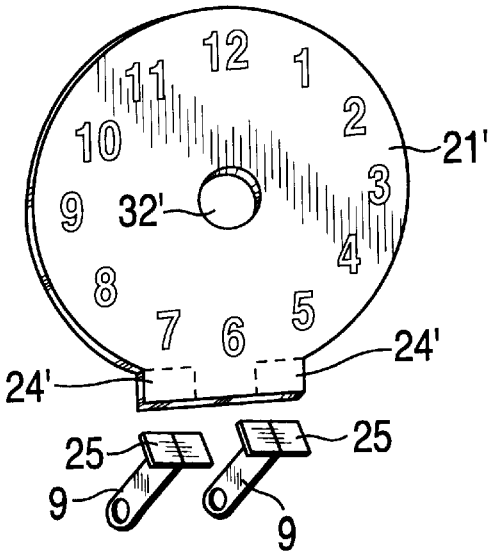
FIG. 5B is a perspective view illustrating an alternative implementation of the preferred night light and time piece.
Figure 5A:
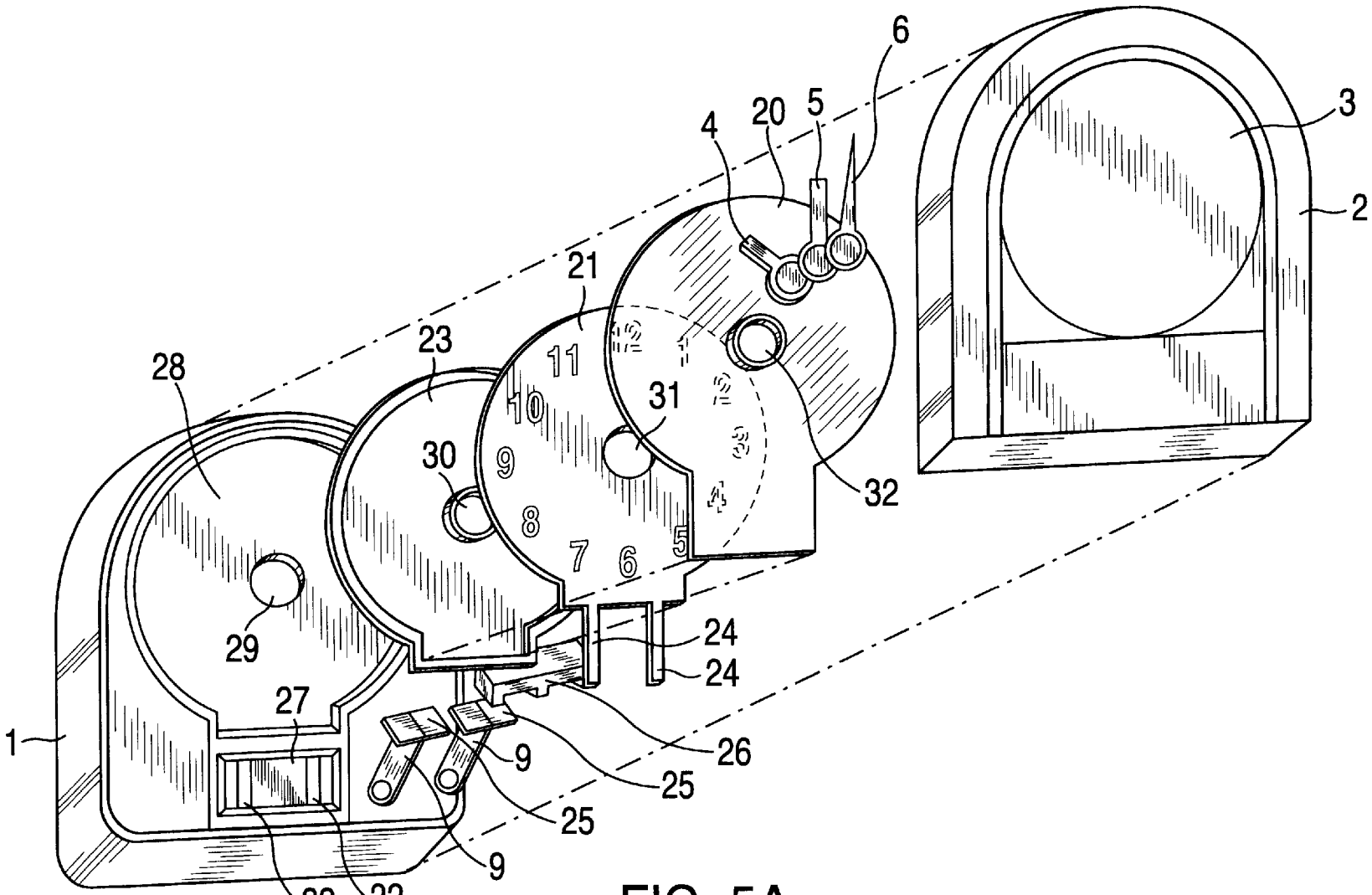
FIG. 5A is an exploded perspective view showing details of one implementation of the preferred night light and time piece.

FIGS. 5A and 5B illustrated two alternative implementations of the night light and time piece illustrated in FIGS. 1–4. In the implementation shown in FIG. 5A, the electro-luminescent element 21 is an inexpensive panel which is not sealed within protective layers, and thus in order to provide protection and moisture, dust, and the like, the electro-luminescent element 21 is sealed between protective members 20 and 23. The seal can take a variety of forms, including o-rings or gaskets, screws, ultra-sonic sealing, adhesives, or other means, so long as the seal protects the electro-luminescent element, with the electrodes 24 being optionally either inside or outside the protective enclosure.

In the implementation shown in FIG. 5A, the numbers of the clock face are printed, painted, or otherwise formed on the electro-luminescent element itself, although it will be appreciated by those skilled in the art that the numbers could also be printed, painted, or otherwise formed on the protective member 20, and that other designs or messages could also be formed either on the electro-luminescent element or the protective member 20 and cover. Preferably, except for any designs formed thereon, protective member 20 is transparent to permit light from the electro-luminescent element to be visible.

The electrical connections used in this implementation include prongs 9, transverse extensions 25 on the prongs, and a fixed member 26 which ensures proper installation of the prongs and electrodes 24 in the manner described in the above cited copending application 08/910,202. Those skilled in the art will appreciate that conductive means such as wires could also be used to establish the electrical connection to the prongs, for example by soldering. A recess 27 is may be included in the rear housing 19 to leave space for the fixed member 26, as necessary, and a recess 28 may also be provided in the rear housing to accommodate the protective member 23 or electro-luminescent element.

Finally, also shown in FIG. 5A are openings 29–32 for the shaft assembly 7 shown in FIGS. 1 and 3.

The implementation illustrated in FIG. 5B differs from that of FIG. 5A in that the electro-luminescent element 21' is of the type already sealed within environmentally protective layers, so that protective members 20 and 23 are not needed, and the element 21' can be positioned directly within recess 28 of rear housing 19, and exposed to opening 3 of front housing 2. In this implementation, electrodes 24' do not need to be extended as in the embodiment of FIG. 5A, and may be engaged directly by extensions 25 of prongs 9, although a conductive member similar to one described in the above-cited copending U.S. patent application Ser. No. 08/910,202 could be included in this implementation if desired, just as the fixed member 26 of FIG. 5A could be eliminated, and some other biasing arrangement being substituted, or the biasing arrangement being dispensed with entirely.

Figure 6A:
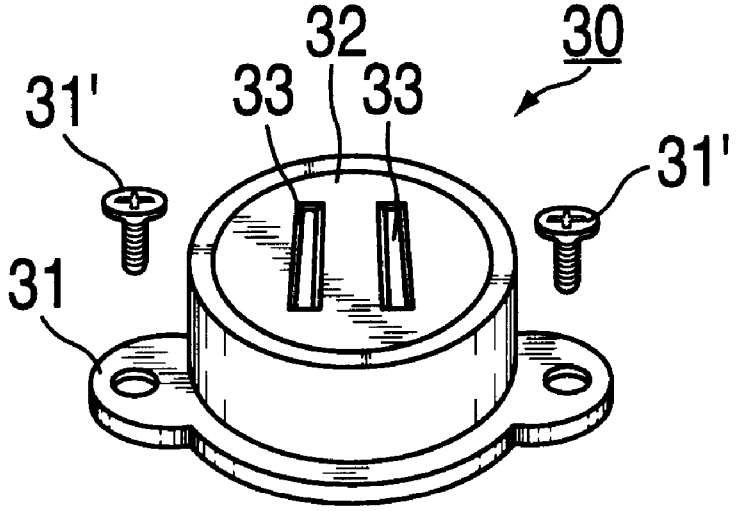
FIGS. 6A and 6B are perspective views of a mechanism for enabling prongs or contacts of the preferred night light and time piece to be swivelled or rotated.
Figure 6B:
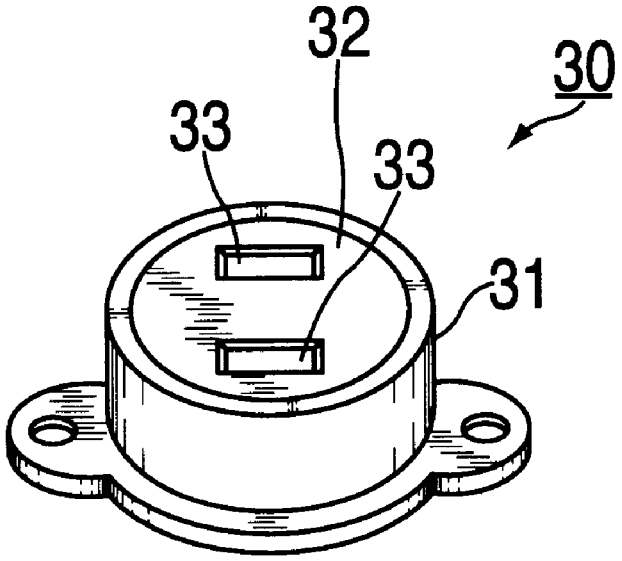
Figure 6C:
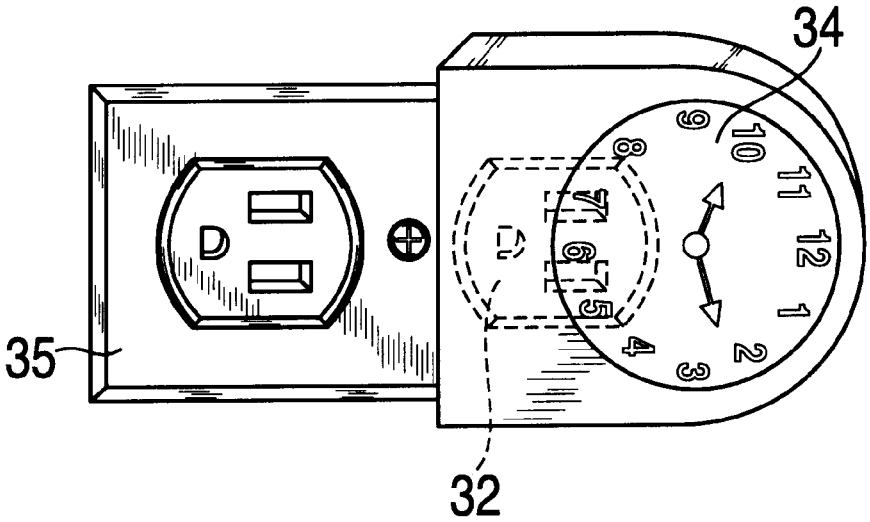
FIGS. 6C and 6D are perspective views illustrating use of a swivel mechanism of the type illustrated in FIGS. 6A and 6B for the purpose of ensuring proper orientation of the preferred night light and time piece.
Figure 6D:
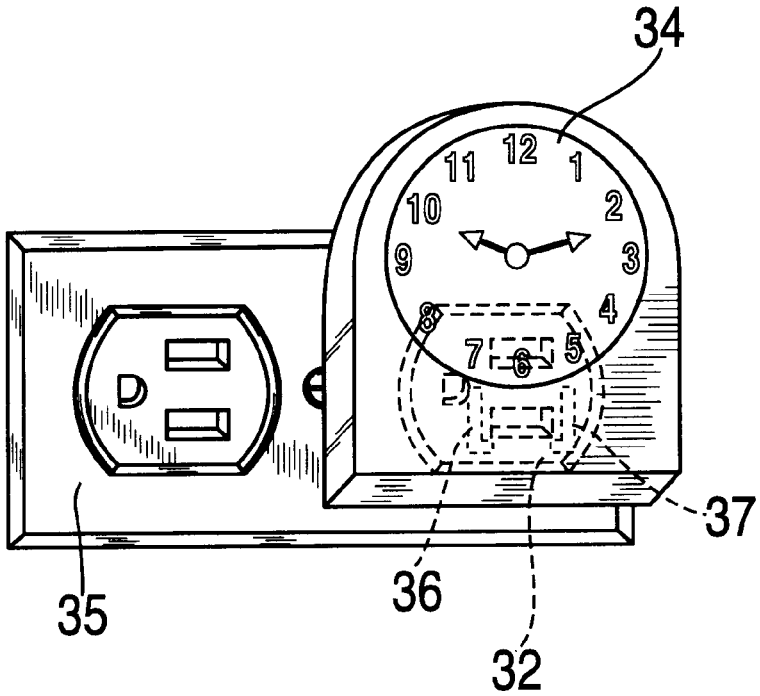
Figure 6E:
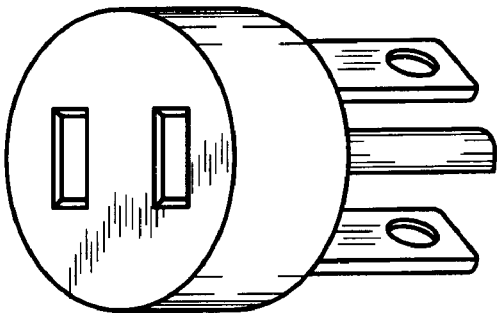
FIGS. 6E–6G are perspective views of adaptor kits for enabling the orientation of the preferred night light/time piece assembly to be changed relative to a power source, or to enable connection to alternative power sources.
Figure 6F:
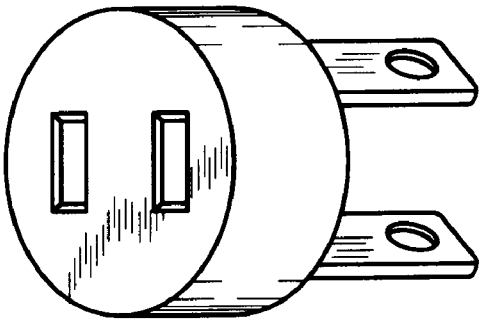
Figure 6G:
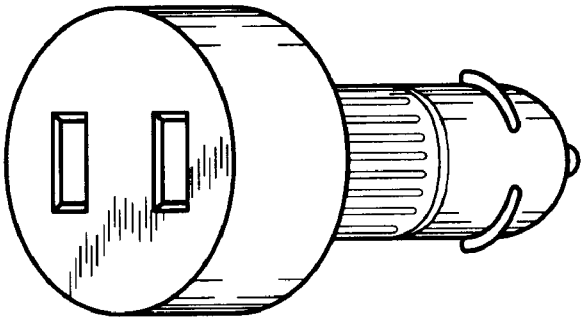

As shown in FIGS. 6A and 6B, instead of the fixed slots 22 shown in FIG. 5A, a mechanism 30 may be included that allows the slots and prongs to rotate. While the mechanism 30 could be implemented in numerous different ways, all of which are intended to be included within the scope of the invention, the mechanism will generally include a housing member 31 that is fixed with respect to the housing of the night light/time piece combination by, for example, screws 31', and a member 32 rotatably supported in the fixed housing member to swivel or rotate from the position shown in FIG. 6A to the one shown in FIG. 6B, and including slots 33 for the prongs or contacts which connect the night light/time piece to a power supply. By permitting the prongs to rotate, the time piece display 34 can be moved from the position shown in FIG. 6C to the one shown in FIG. 6D, so that the display can be more easily read even when the night light/time piece combination is plugged into a horizontally oriented outlet 35. It will of course be appreciated that the form of the outlet illustrated in FIGS. 6C and 6D is by way of example only, and that the night light could be plugged into other types of electrical outlets or power sources. For reasons of cost, for example, instead of providing the swivel mechanism in the night light/time piece assembly housing, adapters could be provided to change the orientation of the assembly or to permit connection to alternative power sources, such as a cigarette lighter socket in a vehicle.

It will of course be appreciated by those skilled in the art that if the prongs are made to swivel or rotate with respect to the night light housing, then the terminals on or extending from the electro-luminescent element will have to be shaped appropriately. For example, the terminals 36 and 37 could have an "L" shape as shown in FIG. 6D so as to contact the prongs in either a vertical or horizontal orientation.

Figure 7:
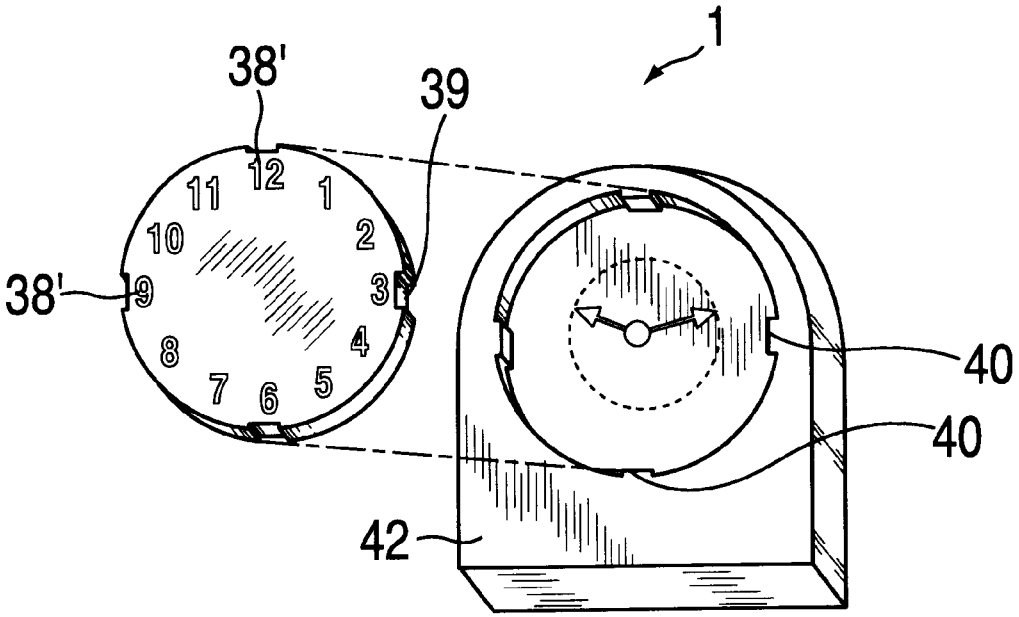
FIG. 7 is a perspective view of an alternative time piece display orientation varying arrangement for use with the night light/time piece of the preferred embodiment.

Turning to FIG. 7, instead of requiring rotation of the prongs of the night light/time piece combination, a cover member 38 on which clock display numbers or other time indicators 38' are printed or otherwise affixed at an appropriate position outside the radius defined by the clock hands could be arranged so that it can be removably secured to the time piece in different orientations. In the example shown in FIG. 7, slots 39 are provided in the cover member 38, with corresponding tracks or ribs 40 being provided in the time piece, and with no numbers being provided on the face 41 of the time piece. The position of the slots 39 and tracks 40 allows the cover member, which provides the time indicating reference display against which the position of the clock hands is judged by the observer, to be oriented at 90° intervals relative to the time piece housing 42, so that the display can be oriented in a desired direction no matter whether the night light/time piece is oriented horizontally or vertically, or even upside-down.

Figure 8:
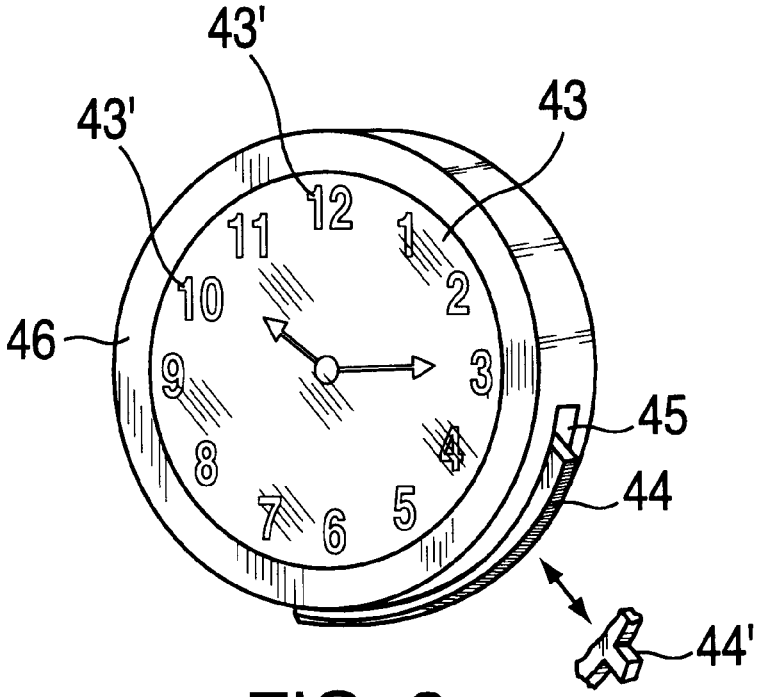
FIG. 8 is a perspective view of another alternative time piece display orientation varying arrangement for use with the night light/time piece of the preferred embodiment.

Even greater versatility can be obtained by the arrangement shown in FIG. 8, in which the clock face display on which the numbers or other time indicators 43' are printed or otherwise affixed is in the form of a dial 43 having an extension 44 which protrudes from a slot 45 so as to allow the clock face display to be rotated relative to the main housing 46 of the night light/time piece arrangement. While extension 44 is illustrated as extending over a relatively large arc, in the neighborhood of 45°, the extension could alternatively be in the form of a small knob 44', or could take any other convenient form for moving the dial 43.

Returning to the basic embodiment of FIGS. 1–5B, although illustrated as a single panel, those skilled in the art will appreciate that the electro-luminescent 21 may include one or more panels or sheets of the type disclosed in U.S. Pat. No. 5,572,817 and copending U.S. patent application Ser. Nos. 08/729,408 , 08/734,872, and 08/746,706, on which designs such as the numbers of the clock face are optionally formed, as indicated above, by printing, painting, silk-screening, stenciling, or the like, and/or by appropriately arranging the phosphor segments of different electro-luminescent panels. In addition, electro-luminescent element 21 may be in the form of one or more three-dimensional electro-luminescent tubes or fibers arranged in an attractive pattern in the manner described in copending U.S. Patent Application Ser. No. 08/758,393. The panel and tubes may be wired in series, in parallel, or completely separately in order to provide a variety of different lighting effects.

The effects obtained by the illustrated electro-luminescent elements may be enhanced by forming the protective member 20 or cover member 38 as an optical effects device similar to the one described in copending U.S. patent application Ser. No. 08/841,624 and its parent U.S. patent application Ser. No. 08/489,160. The optical device can be form a convex or concave lens, and can magnify the image, change the image location, change the focus, or change the color of emitted light in a simple and inexpensive yet effective manner.

Having thus described various preferred embodiments of the invention, those skilled in the art will appreciate that variations and modifications of the preferred embodiment may be made without departing from the scope of the invention. It is accordingly intended that the invention not be limited by the above description or accompanying drawings, but that it be defined solely in accordance with the appended claims.

I claim:

1. An electro-luminescent night light and analog time piece assembly, comprising:

a housing having a front section and a rear section arranged to accommodate the analog time piece and an electro-luminescent lighting element, the analog time piece including hands, said hands being free to rotate about a shaft assembly and thereby indicate the time;

prongs arranged to connect the electro-luminescent lighting element to a power supply; and a power source contained within said assembly for supplying power to the time piece.

2. An assembly as claimed in claim 1, wherein said electro-luminescent lighting element is selected from the group consisting of electro-luminescent panels, sheets, tubes, and fibers mounted on the housing to provide illumination of a clock surface.

3. An assembly as claimed in claim 1, wherein said electro-luminescent lighting element includes or forms an opening for said shaft assembly, and wherein said analog time piece includes at least an hour hand and a minute hand.

4. An assembly as claimed in claim 1, wherein the electro-luminescent lighting element has formed thereon designs selected from the group consisting of indicia, logos, advertisements, characters, figures, numbers, letters, masks, and stencils.

5. An assembly as claimed in claim 1, further comprising a protective member overlaying said electro-luminescent element, wherein the protective member has formed thereon designs selected from the group consisting of indicia, logos, advertisements, characters, figures, numbers, letters, masks, and stencils.

6. An assembly as claimed in claim 1, wherein said assembly includes electrical components selected from the group consisting of an inverter, at least one additional battery for providing power in the event of a power failure, a smoke detector, a flood detector, an earthquake detector, and an animal detector.

7. An assembly as claimed in claim 1, wherein the electro-luminescent lighting element is enclosed between an at least partially transparent front protective member and a rear protective member, said protective members each including a seal for preventing environmental hazards from affecting the electro-luminescent lighting element enclosed therein.

8. An assembly as claimed in claim 7, wherein each seal includes elements selected from the group consisting of screws, ultra-sonic sealing, adhesives, an o-ring, and a gasket.

9. An assembly as claimed in claim 7, wherein electrodes of the electro-luminescent lighting element extend through each seal to connect with said prongs.

10. An assembly as claimed in claim 1, wherein said electro-luminescent lighting element includes electrodes on a surface thereof, said electrodes directly engaging said prongs.

11. An assembly as claimed in claim 1, wherein said electro-luminescent lighting element includes electrodes on a surface thereof, and said assembly further including a resilient conductive member sandwiched between said electrodes and said prongs.

12. An assembly as claimed in claim 1, wherein said prongs are installed between a back housing and an inner plate.

13. An assembly as claimed in claim 1, wherein said time piece is powered by batteries.

14. An assembly as claimed in claim 1, wherein said time piece includes an adjustment feature for adjusting said hands to indicate time.

15. an assembly as claimed in claim 1, wherein said time piece includes means for performing additional functions selected from the group consisting of alarm, time-setting, music, radio, and sensor functions.

16. An assembly as claimed in claim 1, wherein the electro-luminescent lighting element is an electro-luminescent tube arranged in a circle around said shaft assembly.

17. An assembly as claimed in claim 1, further comprising a protective cover overlaying the hands of the time-piece.

18. An assembly as claimed in claim 17, wherein said protective cover provides optical effects.

19. An assembly as claimed in claim 1, further comprising a time piece display, and means for varying the relative rotation of said time piece display with respect to said prongs.

20. An assembly as claimed in claim 19, wherein said prongs are arranged to be rotatable relative to said housing.

21. An assembly as claimed in claim 19, further comprising means for varying the relative rotation of said time piece display with respect to said housing.

22. An assembly as claimed in claim 21, wherein said time piece display includes a cover member on which time indicia are formed, and means for varying the relative rotation of said cover member with respect to the housing.

23. An assembly as claimed in claim 22, wherein said alignment means includes slots or tracks arranged to engage corresponding slots or tracks in said housing.

24. An assembly as claimed in claim 19, wherein said time piece display includes a dial on which time indicia are formed, said dial being arranged to be rotated relative to said housing.

25. An assembly as claimed in claim 24, wherein said dial further includes an extension protruding from a slot in said housing for manipulation by a user to rotate said dial.

26. An assembly as claimed in claim 1, further comprising an adapter, said adapter including means for changing an orientation of the assembly or for connecting the assembly to alternative power sources or devices.

* * * * *